US007726271B2

(12) United States Patent
Yamanishi et al.

(10) Patent No.: US 7,726,271 B2
(45) Date of Patent: Jun. 1, 2010

(54) ENGINE WITH DECOMPRESSION DEVICE

(75) Inventors: Teruhide Yamanishi, Saitama (JP); Shuji Hirayama, Saitama (JP); Yoshitaka Nukada, Saitama (JP); Chiharu Okawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/882,884

(22) Filed: Aug. 6, 2007

(65) Prior Publication Data

US 2008/0035089 A1 Feb. 14, 2008

(30) Foreign Application Priority Data

Aug. 8, 2006 (JP) ..... 2006-215589
Apr. 13, 2007 (JP) ..... 2007-105725

(51) Int. Cl.
*F01L 13/08* (2006.01)

(52) U.S. Cl. ..... 123/182.1; 123/195 P; 123/196 R

(58) Field of Classification Search ..... 123/182.1, 123/195 P, 196 R, 196 W, 144, 274; 384/492; 440/88 R, 89 R
See application file for complete search history.

(56) References Cited

U.S. PATENT DOCUMENTS 1,332,176 A * 2/1920 Heindlhofer ..... 384/492
4,696,266 A 9/1987 Harada
4,790,271 A * 12/1988 Onda ..... 123/182.1
5,711,264 A 1/1998 Jezek et al.
5,884,593 A 3/1999 Immel et al.
7,328,678 B2 * 2/2008 Grybush ..... 123/182.1

FOREIGN PATENT DOCUMENTS

EP 1 380 729 A1 1/2004
EP 1 460 240 A2 9/2004
FR 2 508 995 A 1/1983
JP 2005-307840 A 11/2005

* cited by examiner

*Primary Examiner*—Stephen K Cronin
*Assistant Examiner*—Keith Coleman
(74) *Attorney, Agent, or Firm*—Birch, Stewart, Kolasch & Birch, LLP

(57) ABSTRACT

To suppress the overall length of a camshaft including the length of a decompression device provided in an engine and also to suppress an increase in number of parts of the decompression device, an engine includes a decompression device having a decompression weight pivotably supported through a pivot shaft to a camshaft and adapted to be rotated at a predetermined angle by a centrifugal force generated during the rotation of the camshaft. A weight accommodating portion for pivotably accommodating the decompression weight is formed between the opposite end portions of the camshaft. The outer diameter of the decompression device mounted to the camshaft is smaller than that of a ball bearing. The decompression weight is directly engaged with one end of a decompression camshaft to thereby rotate the decompression camshaft.

20 Claims, 10 Drawing Sheets

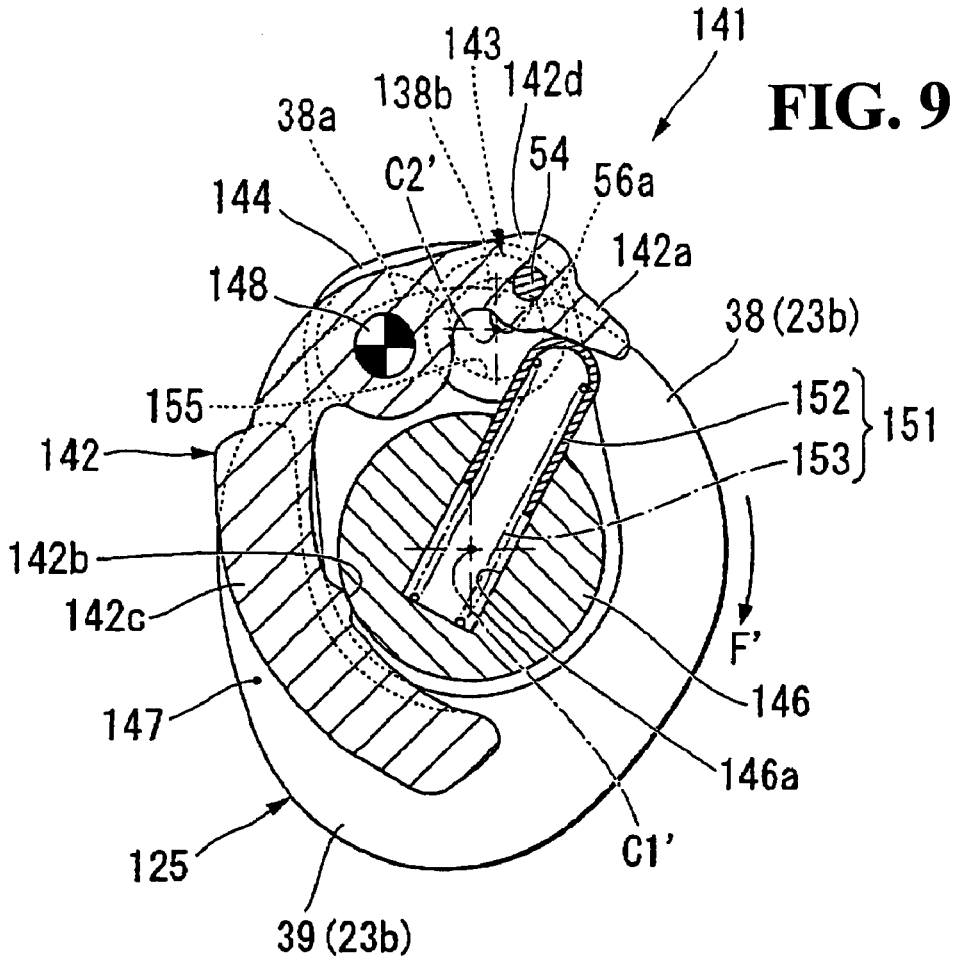
FIG. 9
FIG. 10
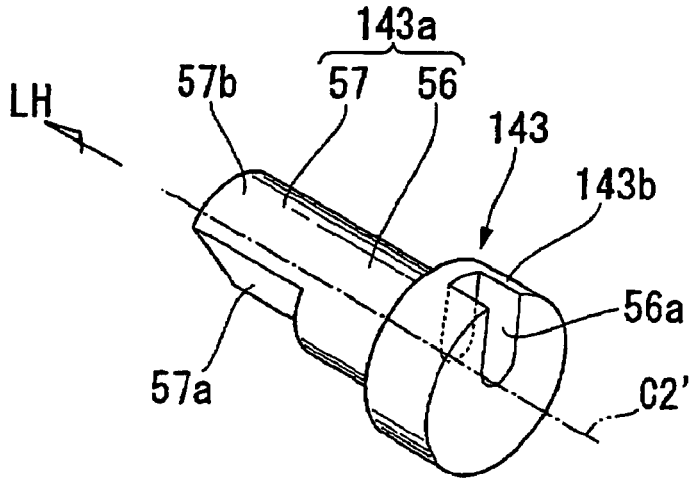

ENGINE WITH DECOMPRESSION DEVICE

CROSS-REFERENCE TO RELATED APPLICATIONS

This nonprovisional application claims priority under 35 U.S.C. §119(a) on Patent Application Nos. 2006-215589 and 2007-105725, filed in Japan on Aug. 8, 2006 and Apr. 13, 2007, respectively. The entirety of each of the above-identified documents is incorporated herein by reference.

BACKGROUND OF THE INVENTION

1. Field of the Invention

The present invention relates to an engine with a decompression device for relieving a compression pressure at starting.

2. Background of the Invention

A conventional engine with such a decompression device includes a camshaft having opposite end portions between which intake and exhaust cams are formed. The camshaft is supported at the opposite end portions by cam supporting portions of an engine body. A decompression weight is pivotably supported through a pivot shaft to the camshaft and is adapted to be rotated at a predetermined angle by a centrifugal force generated during the rotation of the camshaft (see Japanese Patent Laid-open No. 2005-307840, for example).

In this engine, the decompression weight is located axially outside of one supported end portion of the camshaft, and a decompression camshaft located in the vicinity of the exhaust cam extends axially on the side of the one supported end portion of the camshaft. One end of the decompression camshaft is engaged with a connecting portion of the decompression weight through an intermediate member.

In the above configuration according to the background art, the decompression weight is located axially outside of one end of the camshaft, so that the overall length of the camshaft including the length of the decompression device is increased.

Furthermore, the intermediate member is interposed between one end of the decompression camshaft and the decompression weight, so that the number of parts of the decompression device is increased.

SUMMARY OF THE INVENTION

It is accordingly an object of the present invention to suppress the overall length of a camshaft including the length of a decompression device provided in an engine and also to suppress an increase in a number of parts of the decompression device.

In accordance with a first embodiment of the present invention 1, an engine (e.g., engine 1 in a preferred embodiment to be described later) is provided comprising a camshaft (e.g., camshaft 25 in the preferred embodiment) having opposite end portions (e.g., left and right journals 25*a* and 25*b* in the preferred embodiment) between which intake and exhaust cams (e.g., intake and exhaust cams 23*a* and 23*b* in the preferred embodiment) are formed, the camshaft being supported at the opposite end portions by cam supporting portions (e.g., bearing supporting portions 28*a* and 29*a* in the preferred embodiment) of an engine body (e.g., cylinder head 5 in the preferred embodiment); and a decompression device (e.g., decompression device 41 in the preferred embodiment) having a decompression weight (e.g., decompression weight 42 in the preferred embodiment) pivotably supported through a pivot shaft (e.g., pivot shaft 48 in the preferred embodiment) to the camshaft and adapted to be rotated at a predetermined angle by a centrifugal force generated during the rotation of the camshaft; the camshaft having a weight accommodating portion (e.g., weight accommodating portion 47 in the preferred embodiment) for pivotably accommodating the decompression weight between the opposite end portions; at least one end portion of the camshaft being supported through a ball bearing (e.g., right ball bearing 27 in the preferred embodiment) to the engine body; the outer diameter of the decompression device being smaller than that of the ball bearing.

In accordance with a second embodiment of the present invention, an engine (e.g., engine 1 in the preferred embodiment) is provided including a camshaft (e.g., camshaft 25 in the preferred embodiment) having opposite end portions (e.g., left and right journals 25*a* and 25*b* in the preferred embodiment) between which intake and exhaust cams (e.g., intake and exhaust cams 23*a* and 23*b* in the preferred embodiment) are formed, the camshaft being supported at the opposite end portions by cam supporting portions (e.g., bearing supporting portions 28*a* and 29*a* in the preferred embodiment) of an engine body (e.g., cylinder head 5 in the preferred embodiment); and a decompression device (e.g., decompression device 41 in the preferred embodiment) having a decompression weight (e.g., decompression weight 42 in the preferred embodiment) pivotably supported through a pivot shaft (e.g., pivot shaft 48 in the preferred embodiment) to the camshaft and adapted to be rotated at a predetermined angle by a centrifugal force generated during the rotation of the camshaft, and a decompression camshaft (e.g., decompression camshaft 43 in the preferred embodiment) rotatably inserted in a camshaft supporting hole (e.g., camshaft supporting hole 55 in the preferred embodiment) formed in the camshaft, one end of the decompression camshaft opposed to the decompression weight being formed with an engaging portion (e.g., engaging groove 56 in the preferred embodiment) for engaging a connecting portion (e.g., connecting pin 54 in the preferred embodiment) of the decompression weight, whereby the decompression camshaft is rotated by the rotation of the decompression weight through the connecting portion and the engaging portion connected with each other.

In accordance with an aspect of the present invention, the connecting portion is located at a position opposite to a weight portion (e.g., weight portion 142*c* in another preferred embodiment) of the decompression weight with respect to the pivot shaft.

In accordance with another aspect of the present invention, the decompression device further has a return mechanism (e.g., return mechanism 51 in the preferred embodiment) provided between the opposite end portions of the camshaft for returning the decompression weight to the condition before its rotated condition obtained by the centrifugal force.

In accordance with a further aspect of the present invention, the decompression weight and the decompression camshaft are subassembled with the camshaft before inserting the camshaft into the engine body from one side thereof.

In accordance with a further aspect of the present invention, a cooling water pump (e.g., water pump 15 in the preferred embodiment) for circulating cooling water in the engine is provided coaxially with the camshaft.

According to the first embodiment of the present invention, the decompression weight is arranged between the opposite end portions of the camshaft, so that the overall length of the camshaft including the length of the decompression device can be suppressed, and the engine body can be reduced in size owing to the size reduction of the decompression device.

Further, the decompression device is arranged between the opposite end portions of the camshaft, so that the mounting of the decompression device to the camshaft and the mounting of the subassembly of the camshaft with the decompression device to the engine body can be simplified.

According to the present invention, the return mechanism for the decompression weight is located between the opposite end portions of the camshaft to thereby further reduce the overall length of the camshaft including the length of the decompression device.

According to the present invention, an increase in size of the weight portion of the decompression weight can be suppressed to thereby further reduce the size of the decompression device.

According to the present invention, the return mechanism for the decompression weight is located between the opposite end portions of the camshaft to thereby further reduce the overall length of the camshaft including the length of the decompression device.

According to the present invention, the subassembly of the camshaft with the decompression device reduced in size is mounted to the engine body, thereby reducing the number of man-hours for assembly.

According to the present invention, the cooling water pump is provided coaxially with the camshaft assembled with the decompression device to reduce the overall length thereof, so that the projection of the cooling water pump from the engine body can be suppressed.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein:

FIG. 9 is a cross section taken along the line B-B in FIG. 8;

FIG. 10 is a perspective view of a decompression camshaft in the second preferred embodiment;

DETAILED DESCRIPTION OF THE PREFERRED EMBODIMENTS

Figure 1:
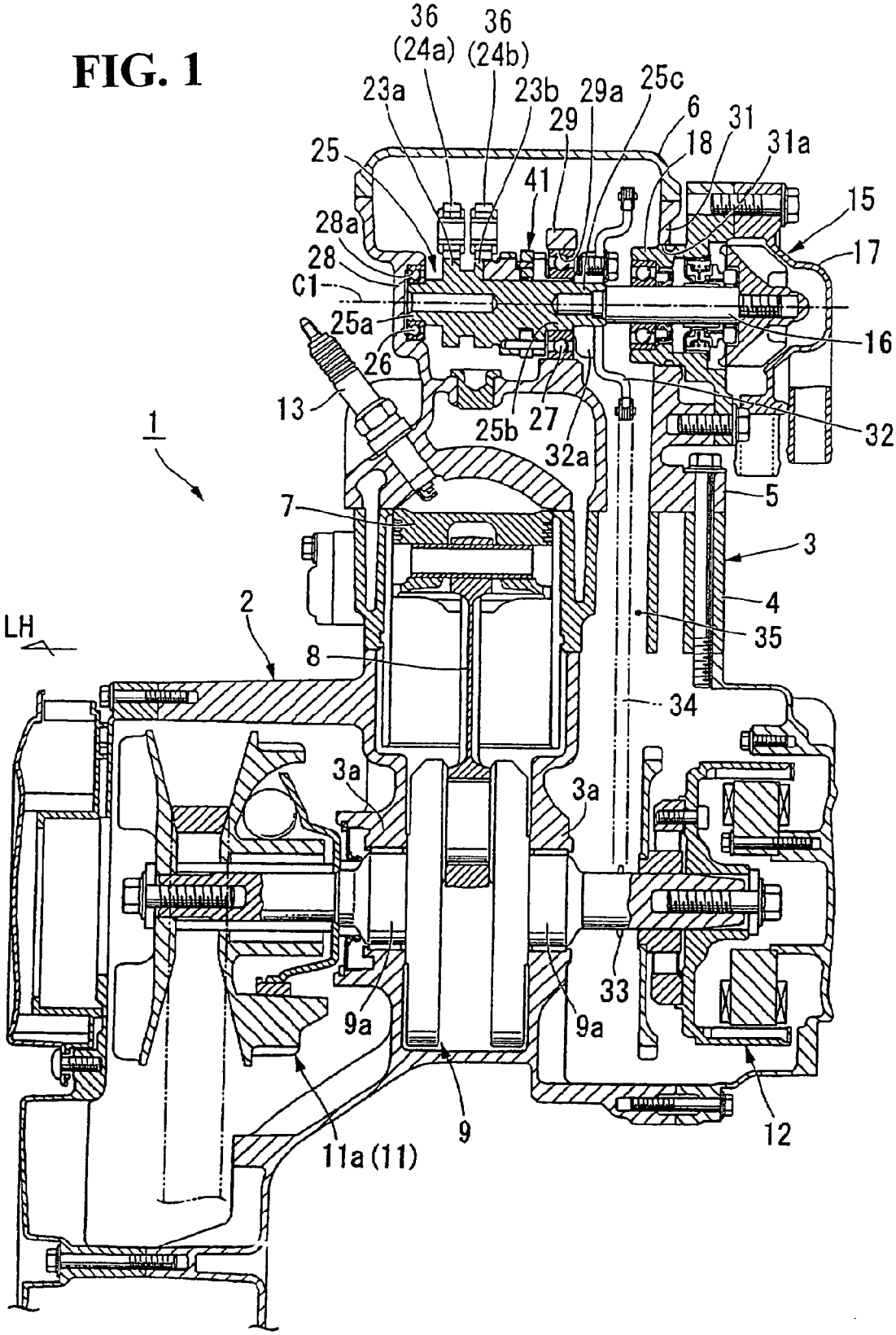
FIG. 1 is a sectional view taken along the crankshaft of the engine according to a preferred embodiment of the present invention.

The present invention will now be described in detail with reference to the accompanying drawings, wherein the same reference numerals will be used to identify the same or similar elements throughout the several views.

First Preferred Embodiment

An engine 1 shown in FIG. 1 is used as a prime mover for a vehicle such as a motorcycle. For example, the engine 1 is a water-cooled, four-stroke cycle, single-cylinder engine.

A cylinder portion 3 projects from a crankcase 2 of the engine 1. The cylinder portion 3 is composed mainly of a cylinder body 4 mounted on the crankcase 2, a cylinder head 5 mounted on the upper end of the cylinder body 4, and a head cover 6 mounted on the upper end of the cylinder head 5. An arrow LH shown in FIG. 1 denotes the left side of the engine 1.

A piston 7 is reciprocatably fitted in the cylinder body 4. The piston 7 is connected through a connecting rod 8 to a crankshaft 9. The crankshaft 9 is rotatably supported at its right and left journals 9*a* to right and left bearing portions 3*a* of the crankcase 2. Torque of the crankshaft 9 is output through a belt type continuously variable transmission mechanism 11, for example. A drive pulley 11*a* of the belt type continuously variable transmission mechanism 11 is supported to a left end portion of the crankshaft 9, and a generator 12 is supported to a right end portion of the crankshaft 9.

Figure 2:
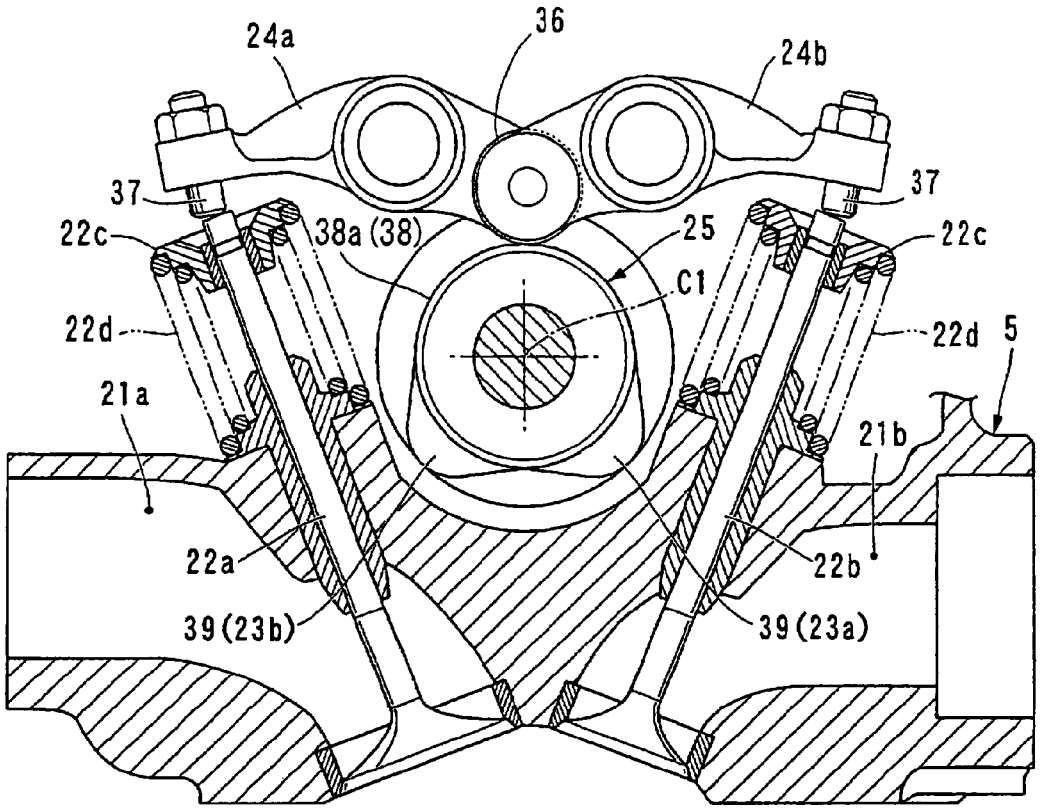
FIG. 2 is a sectional view taken in a direction perpendicular to the axial direction of the camshaft extending in the cylinder head of the engine.

Referring also to FIG. 2, an intake port 21*a* and an exhaust port 21*b* are formed in the cylinder head 5. An opening of the intake port 21*a* exposed to a combustion chamber is normally closed by an intake valve 22*a*, and an opening of the exhaust port 21*b* exposed to the combustion chamber is normally closed by an exhaust valve 22*b*. That is, the intake valve 22*a* is normally biased by a valve spring 22*d* through a retainer 22*c* mounted at the upper end of the stem of the intake valve 22*a*, thereby normally closing the opening of the intake port 21*a* exposed to the combustion chamber. Similarly, the exhaust valve 22*b* is normally biased by a valve spring 22*d* through a retainer 22*c* mounted at the upper end of the stem of the exhaust valve 22*b*, thereby normally closing the opening of the exhaust port 21*b* exposed to the combustion chamber.

A camshaft 25 for driving the intake valve 22*a* and the exhaust valve 22*b* is arranged between the stems of the valves 22*a* and 22*b*. The camshaft 25 extends parallel to the crankshaft 9 in the lateral direction of the engine 1. The camshaft 25 is rotatably supported at its left and right end portions through left and right ball bearings 26 and 27 to a left outer wall 28 and a right inner wall 29 of the cylinder head 5, respectively. An intake cam 23*a* and an exhaust cam 23*b* are formed at an axially intermediate portion of the camshaft 25 (i.e., between the opposite end portions of the camshaft 25) so that the intake cam 23*a* is arranged on the left side of the exhaust cam 23*b*.

As shown in FIG. 1, a driven sprocket 32 is coaxially provided on the right end of the camshaft 25, and a drive sprocket 33 is coaxially provided on a right portion of the crankshaft 9. A cam chain 34 is wrapped between the drive sprocket 33 and the driven sprocket 32, so that the camshaft 25 is rotationally driven in synchronism with the crankshaft 9. A cam chain chamber 35 for accommodating the cam chain 34 is defined in a right portion of the cylinder portion 3.

Figure 3:
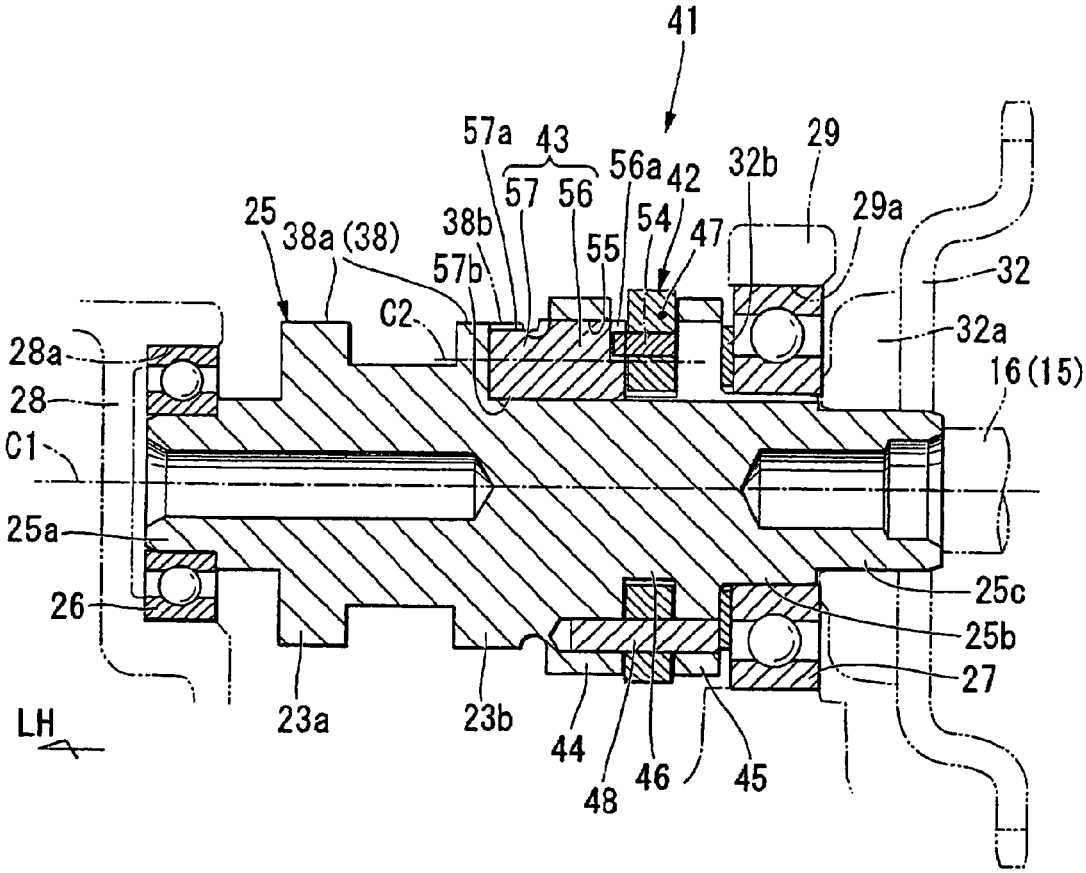
FIG. 3 is an enlarged view of the camshaft and its associated parts shown in FIG. 1.

Referring also to FIG. 3, the left end portion of the camshaft 25 is formed as a left journal 25*a*. The left journal 25*a* is supported through the left ball bearing 26 to the left outer wall 28 to the left outer wall 28 of the cylinder head 5. The inner surface of the left outer wall 28 is formed with a cup-shaped left bearing supporting portion 28*a* opening to the right side (the left journal 25*a* side), and the left ball bearing 26 is fitted in the left ball bearing supporting portion 28*a*.

The right end portion of the camshaft 25 is formed as a right journal 25*b*. The right journal 25*b* is supported through the right ball bearing 27 to the right inner wall 29 of the cylinder head 5. A right projection 25*c* for supporting the driven sprocket 32 is formed on the right side of the right journal 25*b*. The right inner wall 29 is formed with a right bearing supporting portion (supporting hole) 29*a* having a relatively large diameter. The right bearing supporting portion 29*a* extends through the right inner wall 29 in the lateral direction, and the right ball bearing 27 is fitted in the right bearing supporting portion 29*a*. A flange member 32*a* for mounting the driven sprocket 32 is supported to the right projection 25*c*. The right side surface of the inner race of the right ball bearing 27 abuts against the left side surface of the flange member 32*a*, and the left side surface of the inner race of the right ball bearing 27 abuts through a thrust washer 32*b* against the right side surface of a right disk portion 45 of the camshaft 25 which will be hereinafter described.

Referring also to FIG. 2, an intake rocker arm 24*a* is pivotably provided between the intake cam 23*a* and the upper end of the stem of the intake valve 22*a*, and an exhaust rocker arm 24*b* is pivotably provided between the exhaust cam 23*b* and the upper end of the stem of the exhaust valve 22*b*. A cam roller 36 abutting against the outer circumferential surface (cam surface) of the intake cam 23*a* is rotatably provided at a cam-sided end portion (input end portion) of the intake rocker arm 24*a*. Similarly, a cam roller 36 abutting against the outer circumferential surface (cam surface) of the exhaust cam 23*b* is rotatably provided at a cam-sided end portion (input end portion) of the exhaust rocker arm 24*b*. On the other hand, a tappet bolt 37 abutting against the upper end of the stem of the intake valve 22*a* is mounted at a valve-sided end portion (output end portion) of the intake rocker arm 24*a*. Similarly, a tappet bolt 37 abutting against the upper end of the stem of the exhaust valve 22*b* is mounted at a valve-sided end portion (output end portion) of the exhaust rocker arm 24*b*.

When the camshaft 25 is rotationally driven, the intake rocker arm 24*a* is pivotably moved according to the cam pattern of the intake cam 23*a* to thereby reciprocate the intake valve 22*a* and to accordingly open and close the opening of the intake port 21*a* exposed to the combustion chamber. Similarly, the exhaust rocker arm 24*b* is pivotably moved according to the cam pattern of the exhaust cam 23*b* to thereby reciprocate the exhaust valve 22*b* and to accordingly open and close the opening of the exhaust port 21*b* exposed to the combustion chamber. Reference numeral 13 shown in FIG. 1 denotes a spark plug.

The cam rollers 36 of the intake and exhaust rocker arms 24*a* and 24*b* abut against the cam surfaces of the intake and exhaust cams 23*a* and 23*b*, respectively, from the head cover 6 side, and roll on the cam surfaces during the rotation of the camshaft 25. The position of abutment (rolling) of the cam rollers 36 on the cam surfaces of the intake and exhaust cams 23*a* and 23*b* will be hereinafter referred to as a roller contact position.

Referring also to FIG. 2, each of the intake and exhaust cams 23*a* and 23*b* has a cylindrical portion 38 having a cylindrical cam surface coaxial with the camshaft 25 and a cam crest portion 39 projecting radially outwardly from the cylindrical portion 38 to form a crest-shaped cam surface. When the cylindrical portion 38 of each of the intake and exhaust cams 23*a* and 23*b* is in the roller contact position, the intake and exhaust valves 22*a* and 22*b* are not lifted by the intake and exhaust rocker arms 24*a* and 24*b*, thereby maintaining the closed condition of the openings of the intake and exhaust ports 21*a* and 21*b* exposed to the combustion chamber. When the cam crest portion 39 of the intake cam 23*a* or the exhaust cam 23*b* is in the roller contact position, the intake valve 22*a* or the exhaust valve 22*b* is lifted by the intake rocker arm 24*a* or the exhaust rocker arm 24*b*, thereby opening the opening of the intake port 21*a* or the exhaust port 21*b* exposed to the combustion chamber. The cylindrical cam surface of the cylindrical portion 38 of each of the intake and exhaust cams 23*a* and 23*b* will be hereinafter referred to as a zero-lift surface 38*a*.

As shown in FIG. 1, a water pump 15 for circulating a cooling water in the engine 1 is provided on the right side of the camshaft 25. A laterally extending drive shaft 16 of the water pump 15 is arranged coaxially with the camshaft 25. A left end portion of the drive shaft 16 is engaged with a right end portion of the camshaft 25 so as to be nonrotatable relative thereto, so that the drive shaft 16 is driven together with the crankshaft 9 and the camshaft 25. A casing 17 of the water pump 15 has a hub portion 18 for supporting the drive shaft 16. The hub portion 18 projects through a right outer wall 31 of the cylinder head 5 to the left side of the right outer wall 31.

The engine 1 is provided with a decompression device 41 for opening the exhaust valve 22*b*, so as to relieve a compression pressure in the cylinder at starting.

Figure 4:
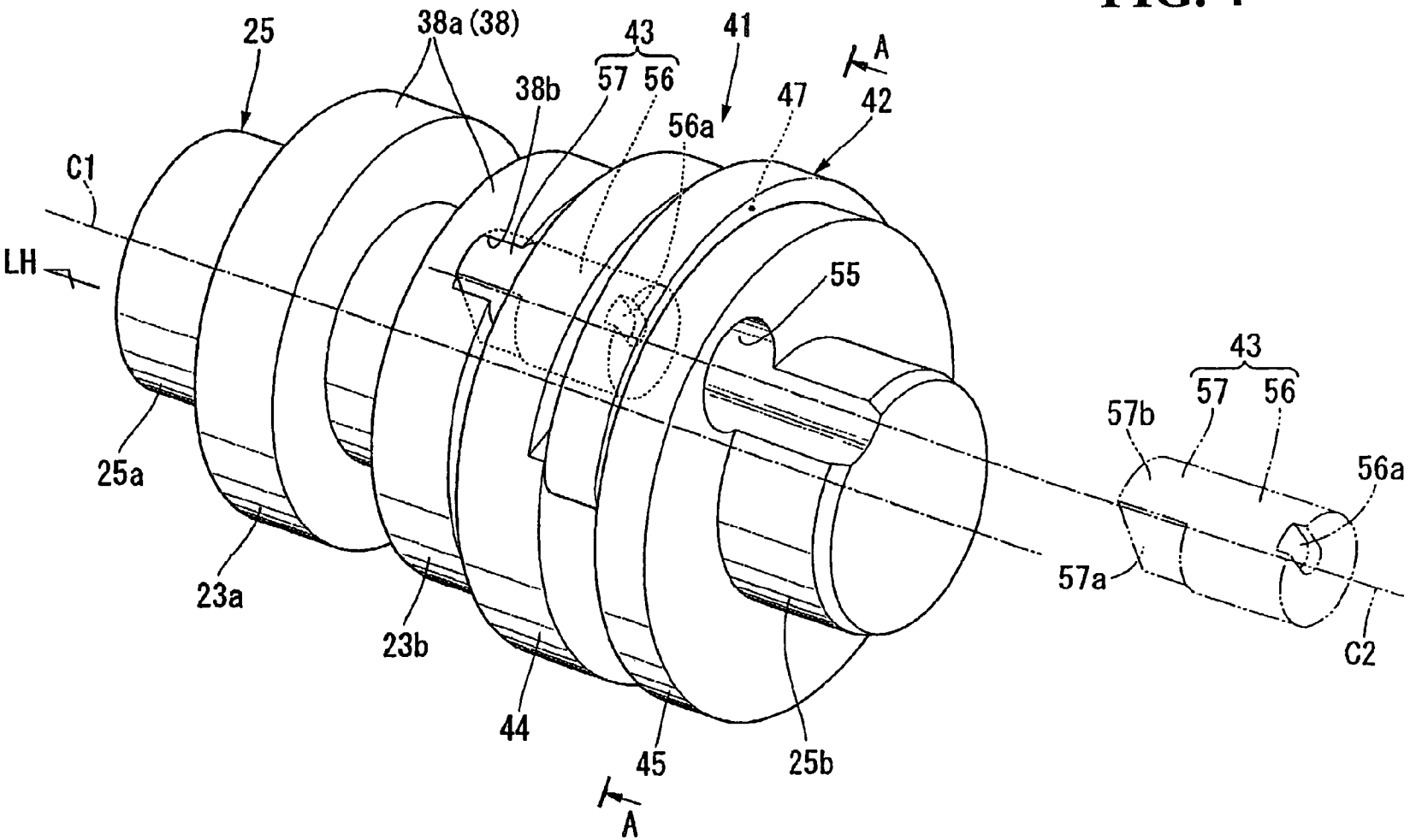
FIG. 4 is a perspective view of the decompression device associated with the camshaft.

As shown in FIGS. 3 and 4, the decompression device 41 is provided between the right journal 25*b* and the exhaust cam 23*b* of the camshaft 25 (i.e., between the opposite end portions of the camshaft 25). The decompression device 41 has a decompression weight 42 adapted to be operated by a centrifugal force generated during the rotation of the camshaft 25 and a decompression camshaft 43 rotatable in concert with the operation of the decompression weight 42. The axial direction along the axis C1 of the camshaft 25 will be hereinafter referred to as a cam axial direction, the circumferential direction about the axis C1 will be hereinafter referred to as a cam circumferential direction, the radial direction toward the axis C1 will be hereinafter referred to as a cam radial inward direction, and the radial direction away from the axis C1 will be hereinafter referred to as a cam radial outward direction.

The right journal 25*b* and the exhaust cam 23*b* are spaced apart from each other by a predetermined distance. A pair of left and right disk portions 44 and 45 larger in diameter than the right journal 25*b* are juxtaposed between the right journal 24*b* and the exhaust cam 23*b*. A predetermined space is defined between the left and right disk portions 44 and 45. That is, a central shaft portion 46 having substantially the same diameter as that of the right journal 25*b* is formed between the left and right disk portions 44 and 45 to define an annular groove as a weight accommodating portion 47. This annular groove is formed by the outer circumferential surface of the central shaft portion 46 and the opposed side surfaces of the left and right disk portions 44 and 45. The decompression weight 42 is accommodated in the weight accommodating portion 47 and operatively mounted to the camshaft 25.

Figure 5:
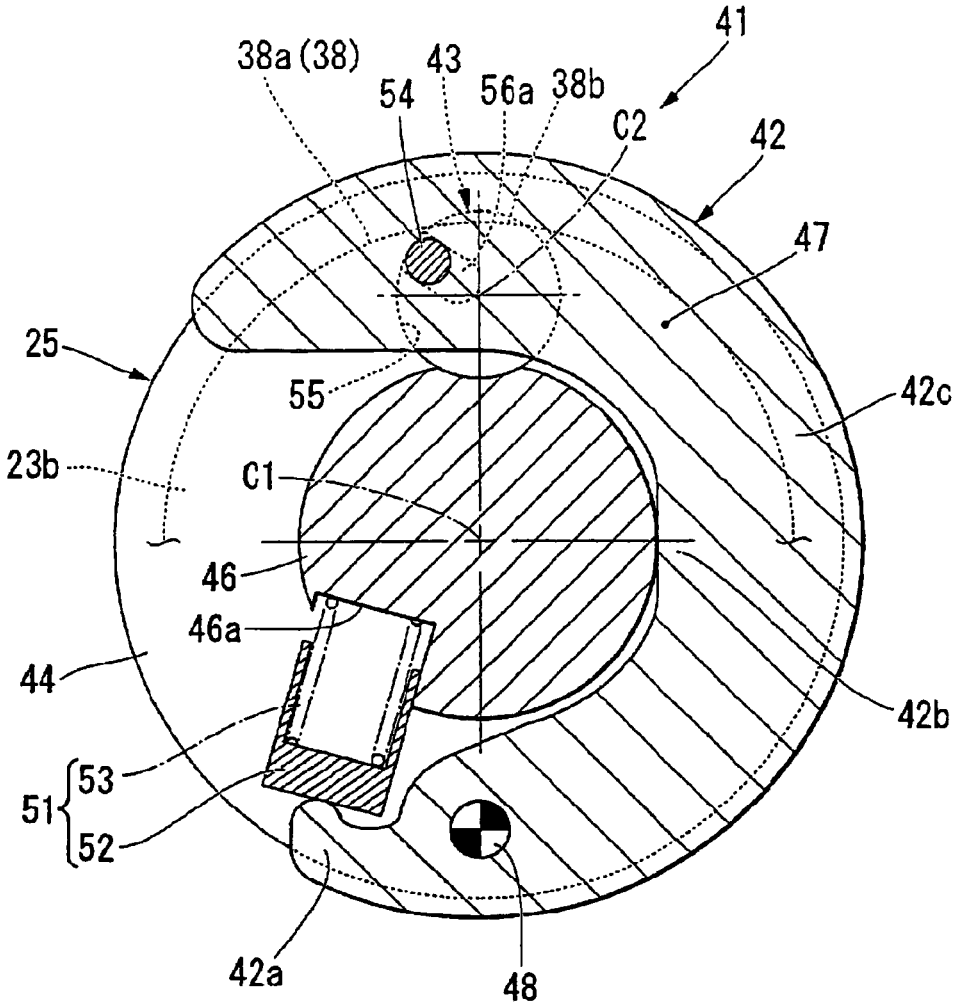
FIG. 5 is a cross section taken along the line A-A in FIG. 4.

Referring also to FIG. 5, the decompression weight 42 has a substantially U-shaped configuration as viewed in the cam axial direction, and it is projectably accommodated in the weight accommodating portion 47 in such a manner that the central shaft portion 46 is embraced by the inner circumference of the decompression weight 42. A pivot shaft 48 is provided at one end portion of the decompression weight 42 so as to extend therethrough in the cam axial direction. The pivot shaft 48 is supported at its opposite end portions to the left and right disk portions 44 and 45. Thus, the decompression weight 42 is pivotably connected to the camshaft 25. The decompression weight 42 has a weight portion 42*c* ranging from the one end portion where the pivot shaft 48 is mounted to the other end portion (i.e., the weight portion 42*c* constitutes almost all portion of the decompression weight 42).

The decompression weight 42 is pivotally moved about the pivot shaft 48 so as to be projected from or retracted into the weight accommodating portion 47. In other words, the decompression weight 42 is pivotally moved about the pivot shaft 48 in the cam radial inward direction or in the cam radial outward direction. Thus, the decompression weight 42 is pivotable about the pivot shaft 48 by a centrifugal force generated during the rotation of the camshaft 25.

The one end portion of the decompression weight 42 is integrally formed with a return arm 42*a* extending from an insert position of the pivot shaft 48 in the cam circumferential direction. Further, a return mechanism 51 for biasing the decompression weight 42 through the return arm 42*a* in the cam radial inward direction is provided on the radially inside of the return arm 42*a*. The return mechanism 51 is located between the left and right disk portions 44 and 45, that is, in the weight accommodating portion 47. The return mechanism 51 has a return piston 52 reciprocating in a direction substantially perpendicular to the direction of extension of the return arm 42*a* as viewed in the cam axial direction and a compression coil spring 53 held under compression between the return piston 52 and a seat forming portion 46*a* recessed from the outer circumference of the central shaft portion 46.

The U-shaped inner circumferential surface of the decompression weight 42 is formed with a stopper wall 42*b* for determining a radial inward limited position of the decompression weight 42 in the weight accommodating portion 47. Further, a radial outward limited position of the decompression weight 42 in the weight accommodating portion 47 is determined by the bottoming of the return piston 52 against the seat forming portion 46*a*.

A connecting pin 54 for connecting the decompression camshaft 43 to the decompression weight 42 is provided at the other end portion (i.e., in the weight portion 42*c*) of the decompression weight 42 so as to extend therethrough in the cam axial direction. The left end of the connecting pin 54 projects leftward from the left side surface of the decompression weight 42. The decompression camshaft 43 is located on the left side of the connecting pin 54 so as to extend in the cam axial direction. The left projecting end portion of the connecting pin 54 is engaged with the right end portion of the decompression camshaft 43. Owing to this engagement of the connecting pin 54 and the decompression camshaft 43, the decompression camshaft 43 can be rotated about its axis C2 in concert with the rotation of the decompression weight 42 about the pivot shaft 48.

The decompression camshaft 43 is rotatably supported in a camshaft supporting hole 55 extending through the left disk portion 44 to the axially central portion of the exhaust cam 23*b*. The decompression camshaft 43 has a solid cylindrical shaft portion 56 forming a right portion and a cam portion 57 forming a left portion. The decompression camshaft 43 is positioned so as to correspond to the cylindrical portion 38 of the exhaust cam 23*b* of the camshaft 25. In other words, the decompression camshaft 43 is positioned between the axis C1 of rotation of the camshaft 25 and the roller contact position of the exhaust cam 23*b* in the condition where the engine 1 is in a compression stroke (in the condition where the cylindrical portion 38 of the exhaust cam 23*b* is in the roller contact position).

The radial outward end of the camshaft supporting hole 55 (or the decompression camshaft 43) is positioned radially outside of the cam surface (zero-lift surface 38*a*) of the cylindrical portion 38 of the exhaust cam 23*b*. That is, the camshaft supporting hole 55 is formed so as to partially cut out the cam surface of the cylindrical portion 38 of the exhaust cam 23*b*. Such a cam surface cutout portion of the exhaust cam 23*b* will be hereinafter denoted by reference numeral 38*b*. The radial inward end of the camshaft supporting hole 55 (or the decompression camshaft 43) is positioned radially inside of the outer circumferential surface of the right journal 25*b*. That is, the camshaft supporting hole 55 extends from the right end of the right journal 25*b* through the right and left disk portions 45 and 44 to the axially central portion of the exhaust cam 23*b* so as to partially cut out the outer circumferential surfaces of the right journal 25*b* and the central shaft portion 46.

The decompression camshaft 43 is inserted into the camshaft supporting hole 55 from its right end until the left end of the decompression camshaft 43 (the left end of the cam portion 57) reaches the bottom of the camshaft supporting hole 55. In this condition where the leftward movement of the decompression camshaft 43 inserted in the camshaft supporting hole 55, the right end of the decompression camshaft 43 (the right end of the shaft portion 56) is substantially flush with the right side surface of the left disk portion 44. In this condition, the decompression weight 42 is accommodated into the weight accommodating portion 47, thereby stopping the rightward movement of the decompression camshaft 43, i.e., the disengagement of the decompression camshaft 43 from the camshaft supporting hole 55.

The return mechanism 51 is preliminarily accommodated in the weight accommodating portion 47, so that the return mechanism 51 is held between the return arm 42*a* of the decompression weight 42 and the seat forming portion 46*a*. In this condition, the pivot shaft 48 is inserted into the camshaft 25, thereby assembling the decompression weight 42, the decompression camshaft 43, and the other associated parts with the camshaft 25.

The right end surface of the decompression camshaft 43 is formed with an engaging groove 56*a* for engaging the left projecting end portion of the connecting pin 54. The engaging groove 56*a* extends from near the center of the right end surface of the decompression camshaft 43 to the outer circumference thereof. The left projecting end portion of the connecting pin 54 is engaged with the engaging groove 56*a* so as to be movable in the direction of extension of the engaging groove 56*a*.

Further, the cam portion 57 of the decompression camshaft 43 is formed by cutting a sectionally segmental portion away from a solid cylinder having the same diameter as that of the shaft portion 56. Such a cutout portion (flat portion) will be hereinafter denoted by reference numeral 57*a*, and the remaining cylindrical portion except the cutout portion 57*a* will be hereinafter denoted by reference numeral 57*b*.

When the cylindrical portion 57*b* of the cam portion 57 is exposed to the cam surface cutout portion 38*b* of the exhaust cam 23*b*, the cylindrical portion 57*b* projects from the zero-lift surface 38*a* by a predetermined amount. When the cam roller 36 of the exhaust rocker arm 24*b* comes to the cam surface cutout portion 38*b*, the substantially right half portion of the cam roller 36 passes over the cam surface cutout portion 38*b* and the substantially left half portion of the cam roller 36 rolls on the cam surface (zero-lift surface 38*a*) formed on the left side of the cam surface cutout portion 38*b* (see FIG. 1). Accordingly, when the cam roller 36 passes over the cam surface cutout portion 38*b* in the condition where the cam portion 57 (cylindrical portion 57*b*) projects from the cam surface cutout portion 38*b*, the cam roller 36 rolls on the cam portion 57 projecting from the cam surface cutout portion 38*b*, thereby pivotally moving the exhaust rocker arm 24*b*. As a result, the exhaust valve 22*b* is lifted to open the opening of the exhaust port 21*b* exposed to the combustion chamber by a predetermined amount.

On the other hand, when the flat portion 57*a* of the cam portion 57 is exposed to the cam surface cutout portion 38*b* of the exhaust cam 23*b*, the flat portion 57*a* does not project from the zero-lift surface 38*a*. Accordingly, when the cam roller 36 of the exhaust rocker arm 24*b* comes to the cam surface cutout portion 38*b* in this condition, the cam roller 36 rolls on the cam surface (zero-lift surface 38*a*) of the exhaust cam 23*b*. As a result, the opening of the exhaust port 21*b* exposed to the combustion chamber is not opened.

The subassembly of the camshaft 25 with the decompression weight 42, the decompression camshaft 43, and the associated parts is mounted into the cylinder head 5 so as to be inserted from the right side thereof along the axis C1.

As shown in FIG. 1, the right outer wall 31 of the cylinder head 5 is formed with a right insert hole 31*a* allowing the insertion of the subassembly of the camshaft 25 mentioned above. The right bearing supporting portion 29*a* of the right inner wall 29 of the cylinder head 5 has an inner diameter allowing the insertion of the left ball bearing 26, the cams 23*a* and 23*b*, the left and right disk portions 44 and 45, and the decompression weight 42. In mounting the subassembly of the camshaft 25 into the cylinder head 5, the subassembly of the camshaft 25 is inserted from the right insert hole 31*a* into the cylinder head 5 and next inserted through the right bearing supporting portion 29*a*. Thereafter, the left ball bearing 26 is fitted to the left ball bearing supporting portion 28*a*, and the right ball bearing 27 is fitted to the right bearing supporting portion 29*a*.

Thereafter, the cam driven sprocket 32 is inserted between the right inner wall 29 and the right outer wall 31 from the upper side of the cylinder head 5, and next fastened to the flange member 32*a*. Thereafter, the water pump 15 is mounted to the right side of the cylinder head 5. That is, the left end portion of the drive shaft 16 is engaged into the right projecting end portion 25*c* of the camshaft 25 so as to be nonrotatable relative thereto, and the hub portion 18 is oil-tightly fitted to the right insert hole 31*a*. In this condition, the casing 17 of the water pump 15 is fastened to the right outer wall 31 of the cylinder head 5. Thus, the mounting of the camshaft 25 and its associated parts to the cylinder head 5 is finished.

The operation of the decompression device 41 will now be described.

Figure 6A:
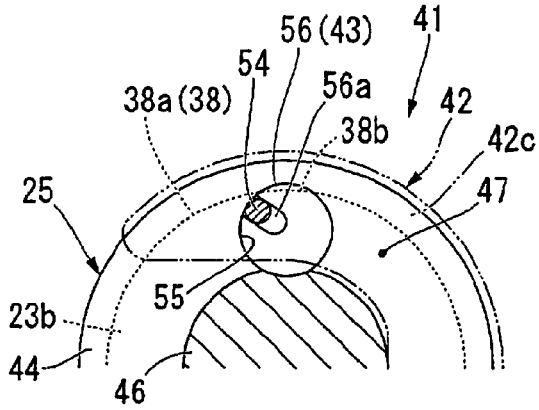
FIG. 6(*a*) is a sectional view at one end of the decompression camshaft, showing the operation of the decompression device in the rest condition of the camshaft, and FIG. 6(*b*) is a sectional view at the cam portion of the decompression camshaft in the same condition as that shown in FIG. 6(*a*)
Figure 6B:
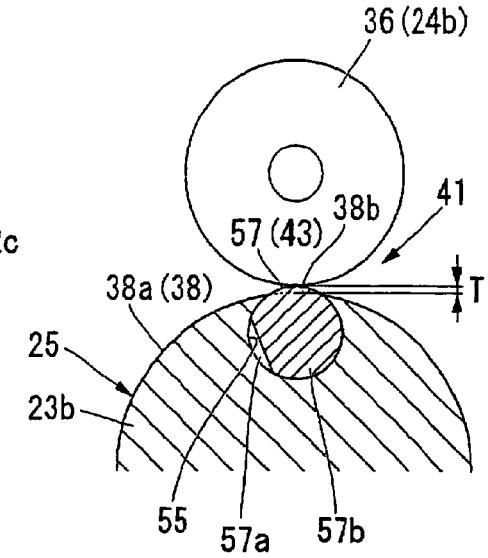
Figure 7A:
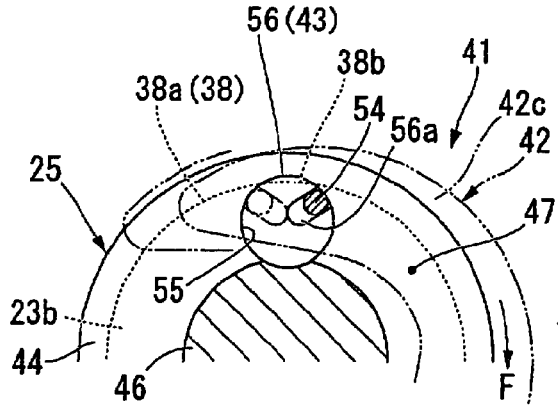
FIG. 7(*a*) is a sectional view at the one end of the decompression camshaft, showing the operation of the decompression device during the rotation of the camshaft, and FIG. 7(*b*) is a sectional view at the cam portion of the decompression camshaft in the same condition as that shown in FIG. 7(*a*)
Figure 7B:
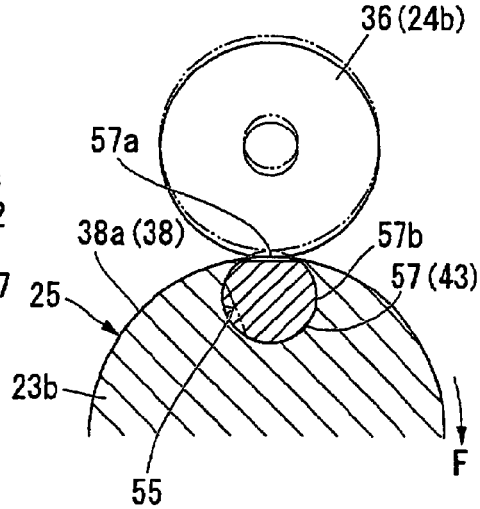

FIGS. 6(*a*) and 6(*b*) show the condition where the decompression weight 42 is in the radial inward limited position in the weight accommodating portion 47 (in the leftmost position as viewed in FIGS. 6(*a*) and 6(*b*)), and FIGS. 7(*a*) and 7(*b*) show the condition where the decompression weight 42 is in the radial outward limited position in the weight accommodating portion 47 (in the rightmost position as viewed in FIGS. 7(*a*) and 7(*b*)).

In the condition shown in FIGS. 6(*a*) and 6(*b*), the engaging groove 56*a* of the decompression camshaft 43 extends from near the center of the right end surface of the decompression camshaft 43 in the cam radial outward direction so as to be inclined leftward as viewed in FIG. 6(*a*). In this condition, the cylindrical portion 57*b* of the cam portion 57 is exposed to the cam surface cutout portion 38*b*, and the flat portion 57*a* of the cam portion 57 is positioned on the left side of the cam surface cutout portion 38*b* and on the cam radial inward side thereof.

On the other hand, in the condition shown in FIGS. 7(*a*) and 7(*b*), the engaging groove 56*a* of the decompression camshaft 43 extends from near the center of the right end surface of the decompression camshaft 43 in the cam radial outward direction so as to be inclined rightward as viewed in FIG. 7(*a*). In this condition, the flat portion 57*a* of the cam portion 57 is exposed to the cam surface cutout portion 38*b*, and the cylindrical portion 57*b* of the cam portion 57 is positioned on the cam radial inward side of the cam surface cutout portion 38*b*.

In the condition where the camshaft 25 is stopped in rotation (or rotated at a speed less than a predetermined speed) and a centrifugal force greater than or equal to a predetermined value does not act on the decompression weight 42, the decompression weight 42 is moved inward of the weight accommodating portion 47 by the biasing force of the return mechanism 51 to keep the condition shown in FIG. 6(*a*). In this condition, the cylindrical portion 57*b* of the cam portion 57 projects from the cam surface cutout portion 38*b* by a distance T shown in FIG. 6(*b*), and the cam roller 36 of the exhaust rocker arm 24*b* present at the cam surface cutout portion 38*b* comes into contact with the cylindrical portion 57*b*. Accordingly, the exhaust valve 22*b* is lifted by the exhaust rocker arm 24*b* to thereby open the opening of the exhaust port 21*b* exposed to the combustion chamber.

On the other hand, in the condition where the camshaft 25 is rotated at a speed greater than or equal to the predetermined speed (corresponding to a rotational speed at engine starting) and a centrifugal force greater than or equal to the predetermined value acts on the decompression weight 42, the decompression weight 42 is moved outward of the weight accommodating portion 47 by the centrifugal force against the biasing force of the return mechanism 51 as shown in FIG. 7*a*. At this time, the connecting pin 54 of the decompression weight 42 operates to rotate the decompression camshaft 43 about the axis C2 from the condition shown in FIG. 6*a* to the condition shown in FIG. 7*a* while the connecting pin 54 is being moved within the engaging groove 56*a*.

As a result, the cylindrical portion 57*b* of the cam portion 57 is retracted from the cam surface cutout portion 38*b*, and the flat portion 57*a* of the cam portion 57 is exposed to the cam surface cutout portion 38*b*. Thus, the projection of the cam portion 57 from the cam surface cutout portion 38*b* is removed. Accordingly, the exhaust valve 22*b* is not lifted at the time the cam roller 36 passes over the cam surface cutout portion 38*b*, thereby maintaining the closed condition of the opening of the exhaust port 21*b* exposed to the combustion chamber. In FIGS. 7(*a*) and 7(*b*), an arrow F denotes the rotational direction of the camshaft 25.

The operation of the engine 1 having the decompression device 41 will now be described.

When the engine 1 is stopped, that is, the rotation of the crankshaft 9 and the camshaft 25 is stopped, the decompression weight 42 is moved inward of the weight accommodating portion 47 by the action of the return mechanism 51, so that the decompression camshaft 43 is rotated so as to expose the cylindrical portion 57*b* to the cam surface cutout portion 38*b* of the exhaust cam 23*b*. Accordingly, the cylindrical portion 57*b* projects from the cam surface (zero-lift surface 38*a*) of the exhaust cam 23*b* by a predetermined amount. The cam surface cutout portion 38*b* is in the roller contact position at the time immediately before the end of the compression stroke of the engine 1 (at the time immediately before the piston 7 reaches a compression top dead center).

When the crankshaft 9 starts to be rotated from the engine stopped condition by the operation of engine starting means such as a starter motor, the cam roller 36 of the exhaust rocker arm 24*b* comes into contact with the cylindrical portion 57*b* projecting from the zero-lift surface 38*a* of the exhaust cam 23*b* at the time immediately before the end of the compression stroke. As a result, the exhaust valve 22*b* is lifted by the action of the exhaust rocker arm 24*b* to open the opening of the exhaust port 21*b* exposed to the combustion chamber by a predetermined amount. Accordingly, a resistance to the rotation of the crankshaft 9 due to a pressure increase at the time immediately before the compression top dead center can be reduced to thereby sufficiently accelerate the rotation of the crankshaft 9.

When the rotation of the crankshaft 9 and the camshaft 25 is accelerated, the decompression weight 42 is moved outward of the weight accommodating portion 47 by a centrifugal force against the biasing force of the return mechanism 51. As a result, the decompression camshaft 43 is rotated so that the cylindrical portion 57*b* is retracted from the cam surface cutout portion 38*b* of the exhaust cam 23*b* and the flat portion 57*a* is exposed to the cam surface cutout portion 38*b*. Accordingly, the projection of the cam portion 57 from the zero-lift surface 38*a* of the exhaust cam 23*b* is removed, and the closed condition of the opening of the exhaust port 21*b* exposed to the combustion chamber is therefore maintained during the compression stroke. Accordingly, the compression stroke can be smoothly shifted to the subsequent combustion stroke. Thus, the engine 1 can be started easily and reliably by reducing an initial input to the engine starting means.

As described above, the engine 1 includes the camshaft 25 having the opposite end portions (left and right journals 25*a* and 25*b*) between which the intake and exhaust cams 23*a* and 23*b* are formed, the camshaft 25 being supported at the opposite end portions by the bearing supporting portions 28*a* and 29*a* of the cylinder head 5, and the decompression device 41 having the decompression weight 42 pivotably supported through the pivot shaft 48 to the camshaft 25 and adapted to be rotated at a predetermined angle by a centrifugal force generated during the rotation of the camshaft 25. In the engine 1 having the decompression device 41 mentioned above, the weight accommodating portion 47 for pivotably accommodating the decompression weight 42 is formed between the opposite end portions of the camshaft 25. Further, the right end portion (right journal) 25*b* of the camshaft 25 as a rear end portion in respect of a mounting direction to the cylinder head 5 is supported through the right ball bearing 27 to the cylinder head 5, and the outer diameter of the decompression device 41 mounted to the camshaft 25 is smaller than that of the right ball bearing 27.

With this configuration, the decompression weight 42 is arranged between the opposite end portions of the camshaft 25, so that the overall length of the camshaft 25 including the length of the decompression device 41 can be suppressed, and the cylinder head 5 can be reduced in size owing to the size reduction of the decompression device 41. Further, the decompression device 41 is arranged between the opposite end portions of the camshaft 25, so that the mounting of the decompression device 41 to the camshaft 25 and the mounting of the subassembly of the camshaft 25 with the decompression device 41 to the cylinder head 5 can be simplified.

In the engine 1 mentioned above, the decompression device 41 further has the decompression camshaft 43 rotatably inserted in the camshaft supporting hole 55 formed in the camshaft 25, and one end of the decompression camshaft 43 opposed to the decompression weight 42 is formed with the engaging groove 56*a* for engaging the connecting pin 54 of the decompression weight 42, whereby the decompression camshaft 43 is rotated by the rotation of the decompression weight 42 through the connecting pin 54 and the engaging groove 56*a* connected with each other. Thus, the connecting pin 54 of the decompression weight 42 is directly engaged with the one end of the decompression camshaft 43 to thereby rotate the decompression camshaft 43. That is, no intermediate member is provided between the decompression weight 42 and the decompression camshaft 43 to thereby reduce the number of parts of the decompression device 41. Further, the decompression weight 42 and the decompression camshaft 43 are arranged close to each other to thereby reduce the overall length of the camshaft 25 including the length of the decompression device 41.

In the engine 1, the decompression device 41 further has the return mechanism 51 provided between the opposite end portions of the camshaft 25 for returning the decompression weight 42 to the condition before its rotated condition obtained by the centrifugal force. Thus, the return mechanism 51 for the decompression weight 42 is located between the opposite end portions of the camshaft 25 to thereby further reduce the overall length of the camshaft 25 including the length of the decompression device 41.

In the engine 1, the decompression weight 42 and the decompression camshaft 43 are subassembled with the camshaft 25 before inserting the camshaft 25 into the cylinder head 5 from one side thereof. Accordingly, the subassembly of the camshaft 25 with the decompression device 41 reduced in size is mounted to the cylinder head 5, thereby reducing the number of man-hours for assembly.

In the engine 1, the water pump 15 for circulating a cooling water in the engine 1 is provided coaxially with the camshaft 25. Accordingly, the water pump 15 is provided coaxially with the camshaft 25 assembled with the decompression device 41 to reduce the overall length thereof. As a result, the projection of the water pump 15 from the cylinder head 5 can be suppressed.

Second Preferred Embodiment

A second preferred embodiment of the present invention will now be described with reference to FIG. 8 to 12.

An engine 101 (decompression device 141) in the second preferred embodiment is different from the engine 1 in the first preferred embodiment mainly in the point that the connecting pin 54 is located at a position opposite to a weight portion 142*c* of a decompression weight 142 with respect to a pivot shaft 148. In the second preferred embodiment, substantially the same parts as those in the first preferred embodiment are denoted by the same reference numerals, and the description thereof will be omitted herein.

Figure 8:
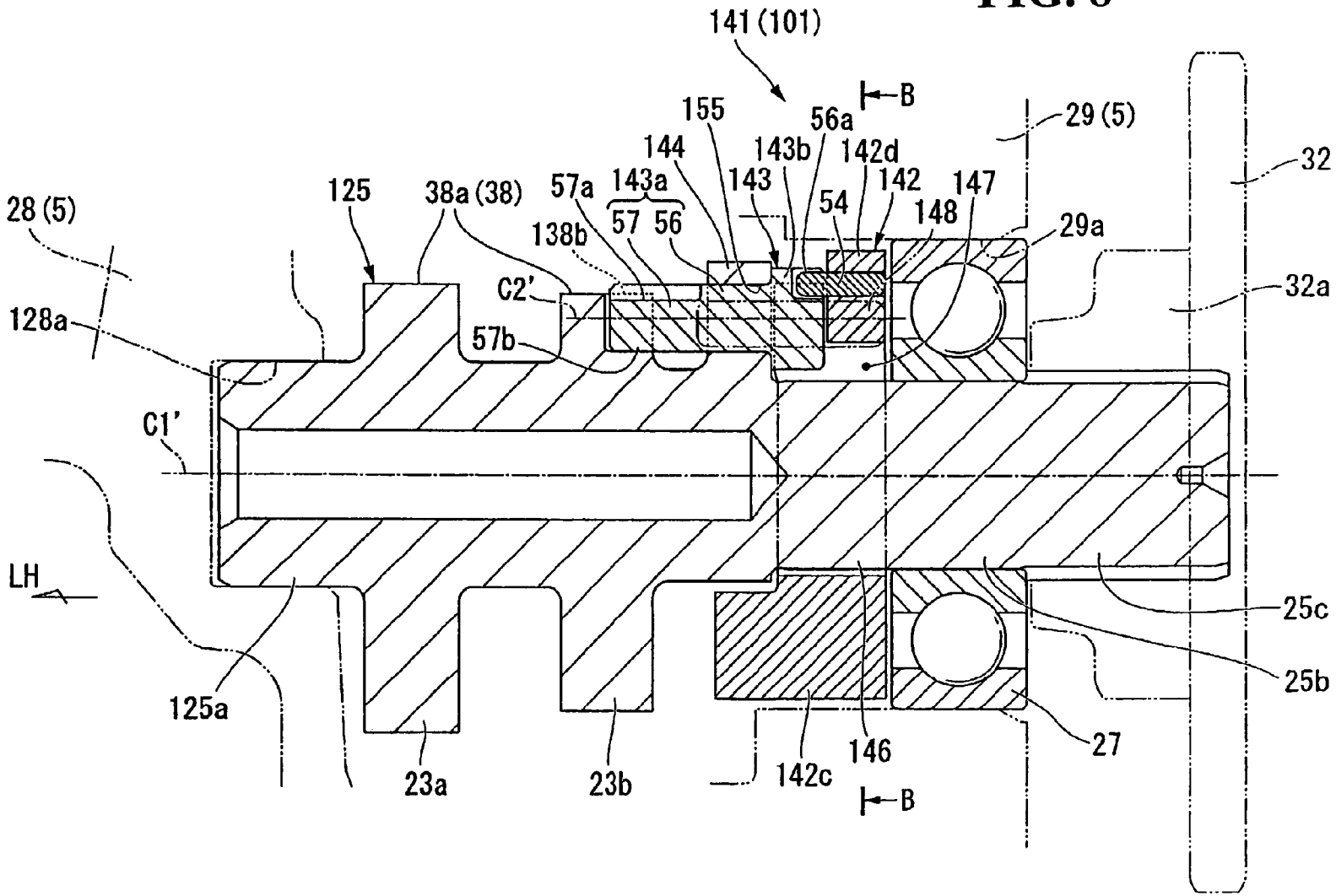
FIG. 8 is an enlarged view similar to FIG. 3, showing a second preferred embodiment of the present invention.

A camshaft 125 shown in FIG. 8 has an axis C1' extending in the lateral direction of the vehicle. A right end portion (right journal 25*b*) of the camshaft 125 is rotatably supported through a right ball bearing 27 to a right bearing supporting portion 29*a* of the right inner wall 29 of the cylinder head 5, and a left end portion (left journal 125*a*) of the camshaft 125 is rotatably supported directly to a left journal supporting portion 128*a* formed on the inner surface of the left outer wall 28 of the cylinder head 5. The left journal 125*a* in the second preferred embodiment is larger in diameter than the left journal 25*a* in the first preferred embodiment. The left journal 125*a* is supported in the cup-shaped left journal supporting portion 128*a* opening to the right side of the left outer wall 28. Alternatively, the left journal 125*a* may be supported through a ball bearing to the left outer wall 28 of the cylinder head 5.

An intake cam 23*a* and an exhaust cam 23*b* are formed at an axially intermediate portion of the camshaft 125 (i.e., between the opposite end portions of the camshaft 125). Further, a driven sprocket 32 is mounted on the right end of the camshaft 125. In the second preferred embodiment, the water pump 15 shown in FIG. 1 is not arranged on the right side of the camshaft 125 (i.e., the drive shaft 16 for the water pump 15 is not engaged with the right end portion of the camshaft 125). However, the water pump 15 may be coaxially provided on the right end of the camshaft 125 as in the first preferred embodiment.

The decompression device 141 is provided between the right journal 25*b* and the exhaust cam 23*b* of the camshaft 125 (i.e., between the opposite end portions of the camshaft 125). The decompression device 141 has a decompression weight 142 adapted to be operated by a centrifugal force generated during the rotation of the camshaft 125 and a decompression camshaft 143 rotatable in concert with the operation of the decompression weight 142.

The right journal 25*b* and the exhaust cam 23*b* are spaced apart from each other by a predetermined distance, and this space between the right journal 25*b* (right ball bearing 27) and the exhaust cam 23*b* is defined as a weight accommodating portion 147. The decompression weight 142 is accommodated in the weight accommodating portion 147 and operatively mounted to the camshaft 125.

Referring also to FIG. 9, the camshaft 125 is formed with a supporting wall portion 144 for supporting the decompression weight 142 and the decompression camshaft 143 at a position near the exhaust cam 23*b* in the weight accommodating portion 147. The supporting wall portion 144 projects in the cam radial outward direction substantially perpendicular to the axis C1' of the camshaft 125. As viewed in the cam axial direction, the supporting wall portion 144 has a rectangular shape having substantially the same width as that of the right journal 25*b*. The decompression weight 142 is supported to the supporting wall portion 144 at its upstream side of the cam circumferential direction (camshaft rotating direction shown by an arrow F' in FIG. 9), and the decompression camshaft 143 is supported to the supporting wall portion 144 at its downstream side in the cam circumferential direction. A shaft portion 146 having substantially the same diameter as that of the right journal 24*b* is formed between the supporting wall portion 144 and the right journal 25*b*.

The decompression weight 142 has a substantially C-shaped configuration (semiannular shape) as viewed in the cam axial direction, and it is projectably accommodated in the weight accommodating portion 147 in such a manner that the shaft portion 146 is embraced by the inner circumference of the decompression weight 142. A pivot shaft 148 is provided at an intermediate portion of the decompression weight 142 so as to extend therethrough in the cam axial direction. A left portion of the pivot shaft 148 is inserted through the supporting wall portion 144, thereby pivotably connecting the decompression weight 142 to the camshaft 125. The decompression weight 142 has a weight portion 142*c* arcuately extending from the intermediate portion where the pivot shaft 148 is inserted to the other end portion (lower end portion as viewed in FIG. 9). The weight portion 142*c* has an increased width in the cam axial direction larger than the width of the intermediate portion as increased to the left side (on the exhaust cam 23*b* side) as shown in FIG. 8. The width of the intermediate portion of the decompression weight 142 in the cam axial direction is substantially equal to the spacing (distance) between the supporting wall portion 144 and the right ball bearing 27.

The decompression weight 142 is pivotally moved about the pivot shaft 148 so that the weight portion 142*c* is projected from the weight accommodating portion 147 in the cam radial outward direction or retracted into the weight accommodating portion 147 in the cam radial inward direction. Thus, the decompression weight 142 is pivotable about the pivot shaft 148 by a centrifugal force generated during the rotation of the camshaft 125.

The one end portion of the decompression weight 142 opposite to the weight portion 142*c* with respect to the pivot shaft 148 is integrally formed with an extended portion 142*d* extending from the insert position of the pivot shaft 148 in the cam circumferential direction. The extended portion 142*d* has a width reduced on the left side in the cam axial direction as shown in FIG. 8 in such a manner that the width of the extended portion 142*d* is smaller than that of the intermediate portion where the pivot shaft 148 is inserted. Further, a part of the intermediate portion of the decompression weight 142 also has a reduced width in the cam axial direction as similar to the extended portion 142*d*. As shown in FIG. 8, a head portion 143*b* of the decompression camshaft 143 is interposed between the extended portion 142*d* (including a part of the intermediate portion) and the supporting wall portion 144.

Referring also to FIG. 10, the decompression camshaft 143 is composed of a body portion 143*a* and a head portion 143*b* formed at the right end of the body portion 143*a* and having a diameter larger than that of the body portion 143*a*. The body portion 143*a* is rotatably supported in a camshaft supporting hole 155 extending through the supporting wall portion 144 to the axially central portion of the exhaust cam 23*b*. The body portion 143*a* is composed of a shaft portion 56 forming a right portion and a cam portion 57 forming a left portion. As mentioned above, the head portion 143*b* is interposed between the extended portion 142*d* and the supporting wall portion 144, so that the axial movement of the decompression camshaft 143 in the cam axial direction is restricted.

A connecting pin 54 for connecting the decompression camshaft 143 to the decompression weight 142 is provided at a longitudinally central portion of the extended portion 142*d* so as to extend therethrough in the cam axial direction. The left end of the connecting pin 54 projects leftward from the left side surface of the extended portion 142*d*. The left projecting end portion of the connecting pin 54 is engaged with an engaging groove 56*a* formed on the right end surface of the head portion 143*b* of the decompression camshaft 143. Owing to this engagement of the connecting pin 54 and the decompression camshaft 143, the decompression camshaft 143 can be rotated about its axis C2' in concert with the rotation of the decompression weight 142 about the pivot shaft 148. Further, the C-shaped inner circumferential surface of the decompression weight 142 is formed with a stopper projection 142*b* for determining a radial inward limited position of the decompression weight 142 in the weight accommodating portion 147.

The front end of the extended portion 142*d* is formed as a return arm 142*a*. Further, a return mechanism 151 for biasing the decompression weight 142 (weight portion 142*c*) through the return arm 142*a* in the cam radial inward direction is provided on the radially inside of the return arm 142*a*. The return mechanism 151 is located in the weight accommodating portion 147. A cylinder hole 146*a* is formed in the shaft portion 146 of the camshaft 125 so as to extend in the radial direction of the shaft portion 146. The return mechanism 151 has a hollow return piston 152 accommodated in the cylinder hole 146*a* so as to be reciprocatable in the axial direction of the cylinder hole 146*a* and a compression coil spring 153 held under compression between the closed end portion of the return piston 152 and the bottom of the cylinder hole 146*a*.

As similar to the decompression camshaft 43 (or the camshaft supporting hole 55) in the first preferred embodiment, the decompression camshaft 143 (or the camshaft supporting hole 155) is positioned so as to correspond to the cylindrical portion 38 of the exhaust cam 23*b* of the camshaft 125. The camshaft supporting hole 155 is formed so as to partially cut out the cam surface (zero-lift surface 38*a*) of the cylindrical portion 38 of the exhaust cam 23*b*. Such a cam surface cutout portion of the exhaust cam 23*b* will be hereinafter denoted by reference numeral 138*b*. The decompression camshaft 143 is inserted into the camshaft supporting hole 155 from its right end prior to the mounting of the decompression weight 142 to the camshaft 125. In this condition, the decompression weight 142 is mounted to the camshaft 125, thus assembling the decompression device 141 and the camshaft 125.

The return mechanism 151 is preliminarily accommodated in the weight accommodating portion 147, so that the return mechanism 151 is held between the return arm 142*a* of the decompression weight 142 and the cylinder hole 146*a* of the shaft portion 146 of the camshaft 125. In this condition, the decompression weight 142 is mounted to the camshaft 125, thus assembling the decompression device 141 and the camshaft 125.

The subassembly of the camshaft 125 with the decompression device 141 is mounted into the cylinder head 5 so as to be inserted from the right side thereof along the axis C1'. The right bearing supporting portion 29*a* of the right inner wall 29 of the cylinder head 5 has an inner diameter allowing the insertion of the cams 23*a* and 23*b* and the supporting wall portion 144 of the camshaft 125 and the decompression device 141 mounted to the camshaft 125.

Figure 11B:
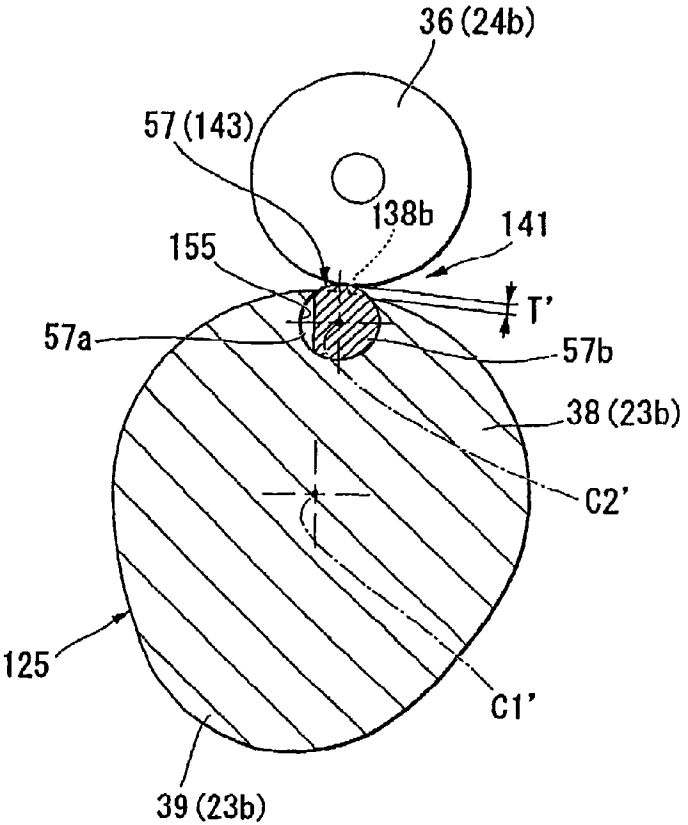
FIG. 11(*a*) is a sectional view at one end of the decompression camshaft, showing the operation of the decompression device according to the second preferred embodiment in the rest condition of the camshaft, and FIG. 11(*b*) is a sectional view at the cam portion of the decompression camshaft in the same condition as that shown in FIG. 11(*a*)
Figure 11A:
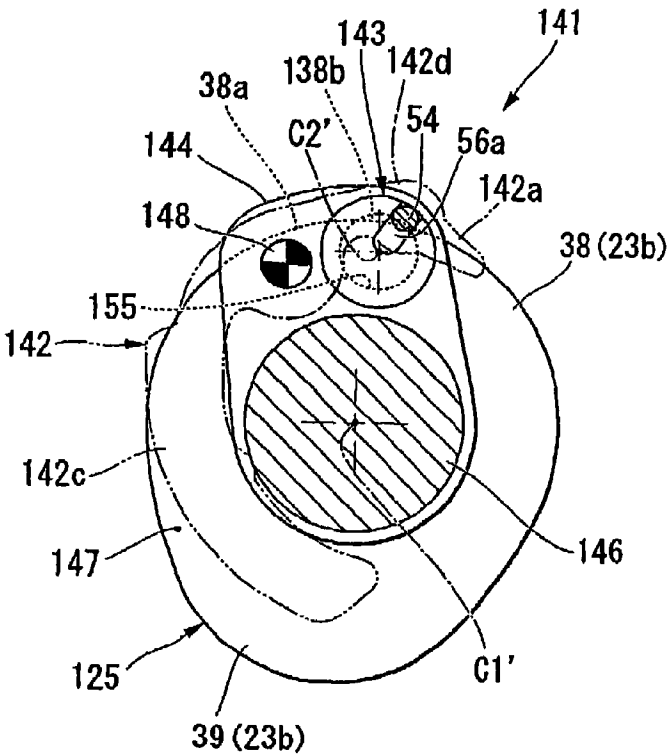

The operation of the decompression device 141 will now be described. FIGS. 11(*a*) and 11(*b*) show the condition where the decompression weight 142 (weight portion 142*c*) is in the radial inward limited position in the weight accommodating portion 147 (in the rightmost position as viewed in FIGS. 11(*a*) and 11(*b*)), and FIGS. 12(*a*) and 12(*b*) show the condition where the decompression weight 142 is in the radial outward limited position in the weight accommodating portion 147 (in the leftmost position as viewed in FIGS. 12(*a*) and 12(*b*)).

In the condition shown in FIGS. 11(*a*) and 11(*b*), the engaging groove 56*a* of the decompression camshaft 143 extends from near the center of the right end surface of the decompression camshaft 143 in the cam radial outward direction so as to be inclined rightward as viewed in FIG. 11(*a*). In this condition, the cylindrical portion 57*b* of the cam portion 57 is exposed to the cam surface cutout portion 138*b*, and the flat portion 57*a* of the cam portion 57 is positioned on the left side of the cam surface cutout portion 138*b* and on the cam radial inward side thereof.

Figure 12B:
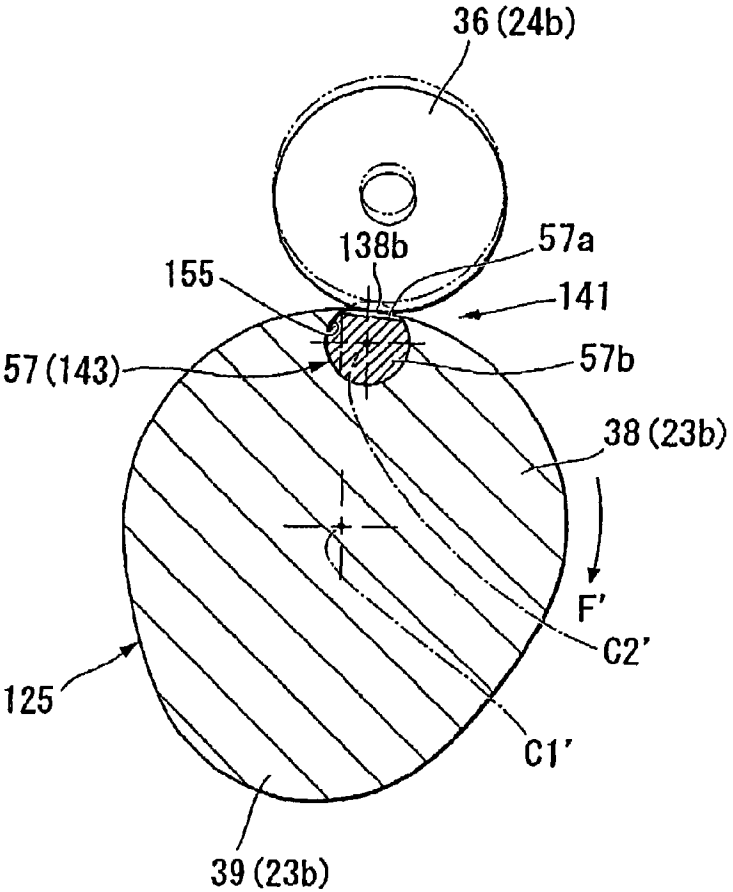
FIG. 12(*a*) is a sectional view at one end of the decompression camshaft, showing the operation of the decompression device according to the second preferred embodiment during the rotation of the camshaft, and FIG. 12(*b*) is a sectional view at the cam portion of the decompression camshaft in the same condition as that shown in FIG. 12(*a*).
Figure 12A:
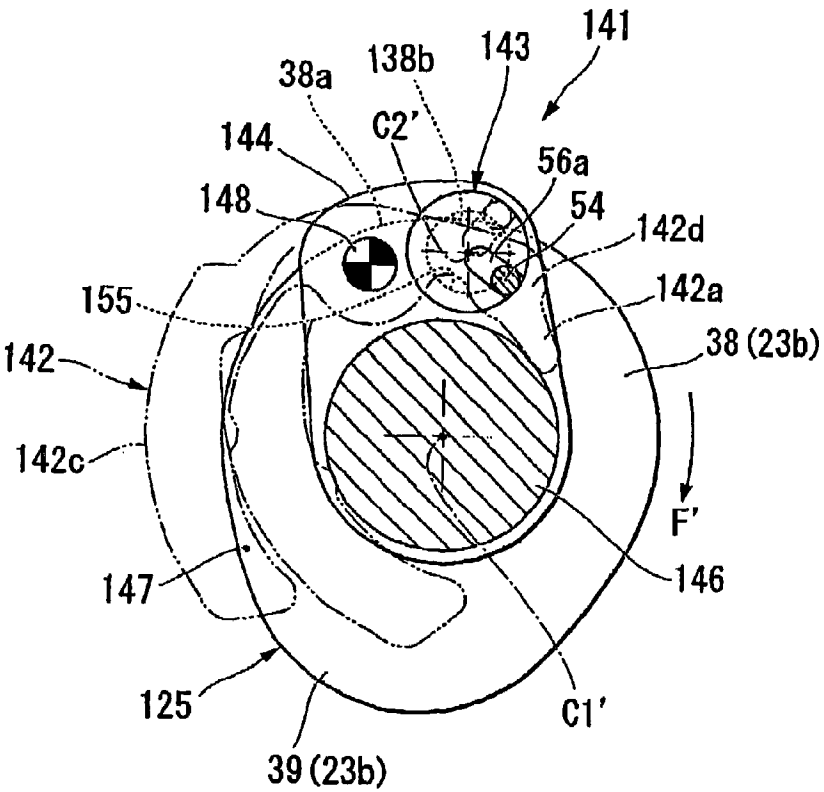

On the other hand, in the condition shown in FIGS. 12(*a*) and 12(*b*), the engaging groove 56*a* of the decompression camshaft 143 extends from near the center of the right end surface of the decompression camshaft 143 in the cam radial inward direction so as to be inclined rightward as viewed in FIG. 12(*a*). In this condition, the flat portion 57*a* of the cam portion 57 is exposed to the cam surface cutout portion 138*b*, and the cylindrical portion 57*b* of the cam portion 57 is positioned on the cam radial inward side of the cam surface cutout portion 138*b*.

In the condition where the camshaft 125 is stopped in rotation (or rotated at a speed less than a predetermined speed) and a centrifugal force greater than or equal to a predetermined value does not act on the weight portion 142*c* of the decompression weight 142, the decompression weight 142 (weight portion 142*c*) is moved inward of the weight accommodating portion 147 by the biasing force of the return mechanism 151 to keep the condition shown in FIG. 11(*a*). In this condition, the cylindrical portion 57*b* of the cam portion 57 projects from the cam surface cutout portion 138*b* by a distance T' shown in FIG. 11(*b*), and the cam roller 36 of the exhaust rocker arm 24*b* present at the cam surface cutout portion 138*b* comes into contact with the cylindrical portion 57*b*. Accordingly, the exhaust valve 22*b* is lifted by the exhaust rocker arm 24*b* to thereby open the opening of the exhaust port 21*b* exposed to the combustion chamber.

On the other hand, in the condition where the camshaft 125 is rotated at a speed greater than or equal to the predetermined speed (corresponding to a rotational speed at engine starting) and a centrifugal force greater than or equal to the predetermined value acts on the weight portion 142*c* of the decompression weight 142, the decompression weight 142 (weight portion 142*c*) is moved outward of the weight accommodating portion 147 by the centrifugal force against the biasing force of the return mechanism 151 as shown in FIG. 12(*a*). At this time, the connecting pin 54 of the decompression weight 142 operates to rotate the decompression camshaft 143 about the axis C2' from the condition shown in FIG. 11(*a*) to the condition shown in FIG. 12(*a*) while the connecting pin 54 is being moved within the engaging groove 56*a*.

As a result, the cylindrical portion 57*b* of the cam portion 57 is retracted from the cam surface cutout portion 138*b*, and the flat portion 57*a* of the cam portion 57 is exposed to the cam surface cutout portion 138*b*. Thus, the projection of the cam portion 57 from the cam surface cutout portion 138*b* is removed. Accordingly, the exhaust valve 22*b* is not lifted at the time the cam roller 36 passes over the cam surface cutout portion 138*b*, thereby maintaining the closed condition of the opening of the exhaust port 21*b* exposed to the combustion chamber.

Also in the engine 101, at engine starting, a resistance of the rotation of the crankshaft 9 due to a pressure increase at the time immediately before the compression top dead center can be reduced to thereby sufficiently accelerate the rotation of the crankshaft 9. Further, the engine 101 can be started easily and reliably by reducing an initial input to the engine starting means.

In the engine 101, the weight accommodating portion 147 for pivotably accommodating the decompression weight 142 is formed between the opposite end portions of the camshaft 125. Further, the right end portion 25*b* of the camshaft 125 as a rear end portion in respect of a mounting direction to the cylinder head 5 is supported through the right ball bearing 27 to the cylinder head 5, and the outer diameter of the decompression device 141 mounted to the camshaft 125 is smaller than that of the right ball bearing 27. With this configuration, the overall length of the camshaft 125 including the length of the decompression device 141 can be suppressed, and the cylinder head 5 can be reduced in size owing to the size reduction of the decompression device 141. Further, the decompression device 141 is arranged between the opposite end portions of the camshaft 125, so that the mounting of the decompression device 141 to the camshaft 125 and the mounting of the subassembly of the camshaft 125 with the decompression device 141 to the cylinder head 5 can be simplified.

In the engine 101, the connecting pin 54 of the decompression weight 142 is directly engaged with the one end of the decompression camshaft 143 to thereby rotate the decompression camshaft 143, so that the number of parts of the decompression device 141 can be reduced. Further, the return mechanism 151 for the decompression weight 142 is located between the opposite end portions of the camshaft 125, so that the overall length of the camshaft 125 including the length of the decompression device 141 can be further reduced and that the number of man-hours for the assembly of the camshaft 125 and the decompression device 141 can be reduced.

In the engine 101, the connecting pin 54 is located at a position opposite to the weight portion 142*c* of the decompression weight 142 with respect to the pivot shaft 148. Accordingly, an increase in size of the weight portion 142*c* of the decompression weight 142 can be suppressed to thereby further reduce the size of the decompression device 141.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An engine comprising:

a camshaft having opposite end portions between which intake and exhaust cams are formed, said camshaft being supported at said opposite end portions by cam supporting portions of an engine body; and a decompression device having a decompression camshaft and a decompression weight pivotably supported through a pivot shaft directly to said camshaft and adapted to be rotated at a predetermined angle by a centrifugal force generated during rotation of said camshaft, wherein said camshaft has a weight accommodating portion for pivotably accommodating said decompression weight between said opposite end portions, at least one end portion of said camshaft is supported through a ball bearing to said engine body, and the outer diameter of said decompression device is smaller than that of said ball bearing, wherein said decompression weight and said decompression camshaft are subassembled with said camshaft before inserting said camshaft into said engine body from one side thereof, and wherein said ball bearing is supported by a bearing support hole in said engine body, the size of the bearing support hole being greater than an outermost diameter of the camshaft and the decompression device, and said camshaft subassembled with the decompression device is inserted into said engine body through said bearing support hole.

2. An engine comprising:

a camshaft having opposite end portions between which intake and exhaust cams are formed, said camshaft being supported at said opposite end portions by cam supporting portions of an engine body, said camshaft being rotated about a first axis; and a decompression device having a decompression weight pivotably supported through a pivot shaft to said camshaft and adapted to be rotated at a predetermined angle by a centrifugal force generated during the rotation of said camshaft, said decompression weight being rotated about a second axis, and a decompression camshaft rotatably inserted in a camshaft supporting hole formed in said camshaft, wherein a connecting portion extends through said decompression weight into said decompression camshaft and is received by an engaging portion formed in the one end of said decompression camshaft opposed to said decompression weight, said decompression camshaft is rotated about a third axis by the rotation of said decompression weight through said connecting portion and said engaging portion connected with each other, and said third axis is spaced apart from said first axis.

3. The engine according to claim 2, wherein said connecting portion is located at a position opposite to a weight portion of said decompression weight with respect to said pivot shaft.

4. The engine according to claim 1, wherein said decompression device further has a return mechanism provided between said opposite end portions of said camshaft for returning said decompression weight to the condition before its rotated condition obtained by said centrifugal force.

5. The engine according to claim 2, wherein said decompression device further has a return mechanism provided between said opposite end portions of said camshaft for returning said decompression weight to the condition before its rotated condition obtained by said centrifugal force.

6. The engine according to claim 3, wherein said decompression device further has a return mechanism provided between said opposite end portions of said camshaft for returning said decompression weight to the condition before its rotated condition obtained by said centrifugal force.

7. The engine according to claim 1, wherein a cooling water pump for circulating cooling water in said engine is provided coaxially with said camshaft.

8. The engine according to claim 2, wherein a cooling water pump for circulating cooling water in said engine is provided coaxially with said camshaft.

9. The engine according to claim 3, wherein a cooling water pump for circulating cooling water in said engine is provided coaxially with said camshaft.

10. The engine according to claim 4, wherein one end portion of the decompression weight is integrally formed with a return arm extending from an insert position of the pivot shaft in a cam circumferential direction, and the return mechanism biases the decompression weight through the return arm in a cam radial inward direction.

11. The engine according to claim 5, wherein one end portion of the decompression weight is integrally formed with a return arm extending from an insert position of the pivot shaft in a cam circumferential direction, and the return mechanism biases the decompression weight through the return arm in a cam radial inward direction.

12. The engine according to claim 6, wherein one end portion of the decompression weight is integrally formed with a return arm extending from an insert position of the pivot shaft in a cam circumferential direction, and the return mechanism biases the decompression weight through the return arm in a cam radial inward direction.

13. The engine according to claim 1, wherein the decompression weight is generally U-shaped, and an inner circumferential surface of the decompression weight is formed with a stopper wall for determining a radial inward limited position of the decompression weight in the weight accommodating portion.

14. The engine according to claim 2, wherein the decompression weight is generally U-shaped, and an inner circumferential surface of the decompression weight is formed with a stopper wall for determining a radial inward limited position of the decompression weight in a weight accommodating portion formed between said opposite end portions of the camshaft.

15. The engine according to claim 3, wherein the decompression weight is generally U-shaped, and an inner circumferential surface of the decompression weight is formed with a stopper wall for determining a radial inward limited position of the decompression weight in a weight accommodating portion formed between said opposite end portions of the camshaft.

16. The engine according to claim 1, wherein a connecting pin extends into said decompression camshaft and extends through said decompression weight to connect said decompression camshaft and said decompression weight.

17. The engine according to claim 16, wherein said connecting pin extends into said decompression camshaft and extends through said decompression weight in a length direction parallel to an axial direction of said camshaft.

18. The engine according to claim 1, wherein said camshaft is rotated about a first axis and said decompression camshaft is rotated about a second axis spaced apart from said first axis.

19. The engine according to claim 2, wherein said connecting portion extends into said decompression camshaft and extends through said decompression weight.

20. The engine according to claim 2, wherein said connecting portion extends into said decompression camshaft and extends through said decompression weight in a length direction parallel to said first axis.

* * * * *